US006360711B1

(12) United States Patent
Itoh

(10) Patent No.: US 6,360,711 B1
(45) Date of Patent: Mar. 26, 2002

(54) ENGINE HOLDER STRUCTURE FOR FOUR-CYCLE OUTBOARD MOTOR

(75) Inventor: Jun Itoh, Hamamatsu (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 09/651,452

(22) Filed: Aug. 30, 2000

(30) Foreign Application Priority Data

Aug. 31, 1999 (JP) ..... 11-246807

(51) Int. Cl.[7] ..... F02F 7/00
(52) U.S. Cl. ..... 123/195 P; 123/196 R
(58) Field of Search ..... 123/195 P, 195 R; 440/88, 89, 900, 83

(56) References Cited

U.S. PATENT DOCUMENTS 5,769,675 A * 6/1998 Takahashi et al. ..... 440/83

FOREIGN PATENT DOCUMENTS

| | | | |
|---|---|---|---|
| JP | 02274691 | A | 11/1990 |
| JP | 04345592 | A | 12/1992 |
| JP | 05026175 | A | 2/1993 |
| JP | 07324659 | A | 12/1995 |
| JP | 08100614 | A | 4/1996 |
| JP | 10159532 | A | 6/1998 |
| JP | 10218090 | A | 8/1998 |

* cited by examiner

*Primary Examiner*—Noah P. Kamen
(74) *Attorney, Agent, or Firm*—Morrison Law Firm

(57) ABSTRACT

The present invention provides an engine holder structure for a four-cycle outboard motor such that rigidity of an assembled engine can be increased with a simple structure. In accordance with the present invention, the shaft center of a drive shaft 10 is disposed offset from the shaft center of a crankshaft 4 with an outboard motor where an engine 3, mainly composed of a crankcase 25, a cylinder block 24 and a cylinder head 23, is mounted on an upper portion of an engine holder 2, a lower portion of which an oil pan 5 is fixed to; a crankshaft 4 is disposed substantially vertically inside the engine 3; and the rotation of this crankshaft 4 is transmitted to a propulsion device via a drive shaft 10.

7 Claims, 5 Drawing Sheets

ENGINE HOLDER STRUCTURE FOR FOUR-CYCLE OUTBOARD MOTOR

BACKGROUND OF THE INVENTION

This application incorporates by reference the disclosures of co-pending patent applications Ser. No. 09/651,688 by Masashi Takayanagi entitled "Four-Cycle Outboard Motor" and Ser. No. 09/650,829 by Keisuke Daikoku and Masashi Takayanagi entitled "Four-Cycle Outboard Motor" each of which is filed concurrently with the present application and is assigned to the assignee of the present application.

1. Field of the Invention

The present invention relates to an engine holder structure for a four-cycle outboard motor.

2. Description of the Related Art

Most outboard motors have a vertical-type engine which is mounted in the upper part of an engine holder attached to the hull via a clamp bracket and has a crankshaft disposed substantially vertically inside the engine. In the case of a four-cycle engine, an oil pan is generally disposed below the engine holder.

In some outboard motors, the drive shaft that transmits the drive force of the crankshaft to the propeller is disposed offset from the crankshaft. In outboard motor engines of this sort, only the cylinder block and the crankcase of the engine are fixed to the engine holder as shown in Japanese Laid-open Patent Application No. 2-274691, for example.

Also, as shown in Japanese Laid-open Patent Application Nos. 4-345592 and 10-218090, for example, an engine and an oil pan of a conventional outboard motor are securely fixed to an engine holder with separate bolts, and the bolts that securely fix the engine pass through the oil pan and engine holder from below whereby the engine holder and the oil pan are secured together with the cylinder block of the engine.

However, a structure wherein only the cylinder block and crankcase of the engine are fixed to the engine holder has a small interfacial area (or connection area) between the engine and engine holder which may result in the engine being attached with insufficient rigidity, especially in a large-scale outboard motor.

Also, since the cylinder head is not fixed to the engine holder, oil that has lubricated the interior of the cylinder head has to pass through the cylinder block before it can be guided to the oil pan, which may result in a more complex structure and weight increase.

Furthermore, in a structure where the engine and the oil pan are securely fixed to the engine holder with separate bolts, which pass through the oil pan and the engine holder from below whereby the engine holder and the oil pan are secured together with the cylinder block of the engine, the assembly rigidity of the entire outboard motor is low and many bolts are also required so that an increased number of components and an increased amount of labor are required for assembly.

With the foregoing in view, it is an object of the present invention to provide an engine holder structure for a four-cycle outboard motor wherein the attachment rigidity of the engine can be increased with a simple structure.

SUMMARY OF THE INVENTION

The present invention satisfies the above-described needs by providing an engine holder structure for a four-cycle outboard motor where an engine principally composed of a crankcase, a cylinder block and a cylinder head is mounted above an engine holder, where an oil pan is disposed therebelow, where a crankshaft is disposed substantially vertically inside the engine, and where the rotational force of this crankshaft is transmitted to a propulsion device via a drive shaft; wherein the engine holder structure is characterized in that the shaft center of the drive shaft is disposed offset from the shaft center of the crankshaft.

According to another aspect of the present invention, an engine holder structure for a four-cycle outboard motor comprises an engine principally composed of a crankcase, a cylinder block and a cylinder head that are mounted above an engine holder, an oil pan disposed therebelow, a crankshaft disposed substantially vertically inside the engine, wherein the rotation of this crankshaft is transmitted to a propulsion device via a drive shaft, wherein the engine holder structure is characterized in that the shaft center of the drive shaft is disposed offset from the shaft center of the crankshaft, and the cylinder head, the cylinder block and the crankcase are all securely fixed to the engine holder.

According to yet another aspect of the present invention, the engine holder and the oil pan may further be fastened together with at least one of the components of the engine.

Also, according to another aspect of the present invention, the engine holder and the oil pan may be fastened together with the cylinder block and the cylinder head.

Also, according to another aspect of the present invention, an oil drop hole may be formed in the lower surface of the cylinder head at the side of the interface between the cylinder head and the engine holder, and another oil drop hole may be formed in the upper surface of the engine holder at the side of the interface between the cylinder head and the engine holder.

Also, according to another aspect of the present invention, the shaft center of the drive shaft is disposed offset to the rear of the shaft center of the crankshaft.

DETAILED DESCRIPTION OF THE PREFERRED EMBODIMENT

Embodiments of the present invention are described below based on the figures.

Figure 1:
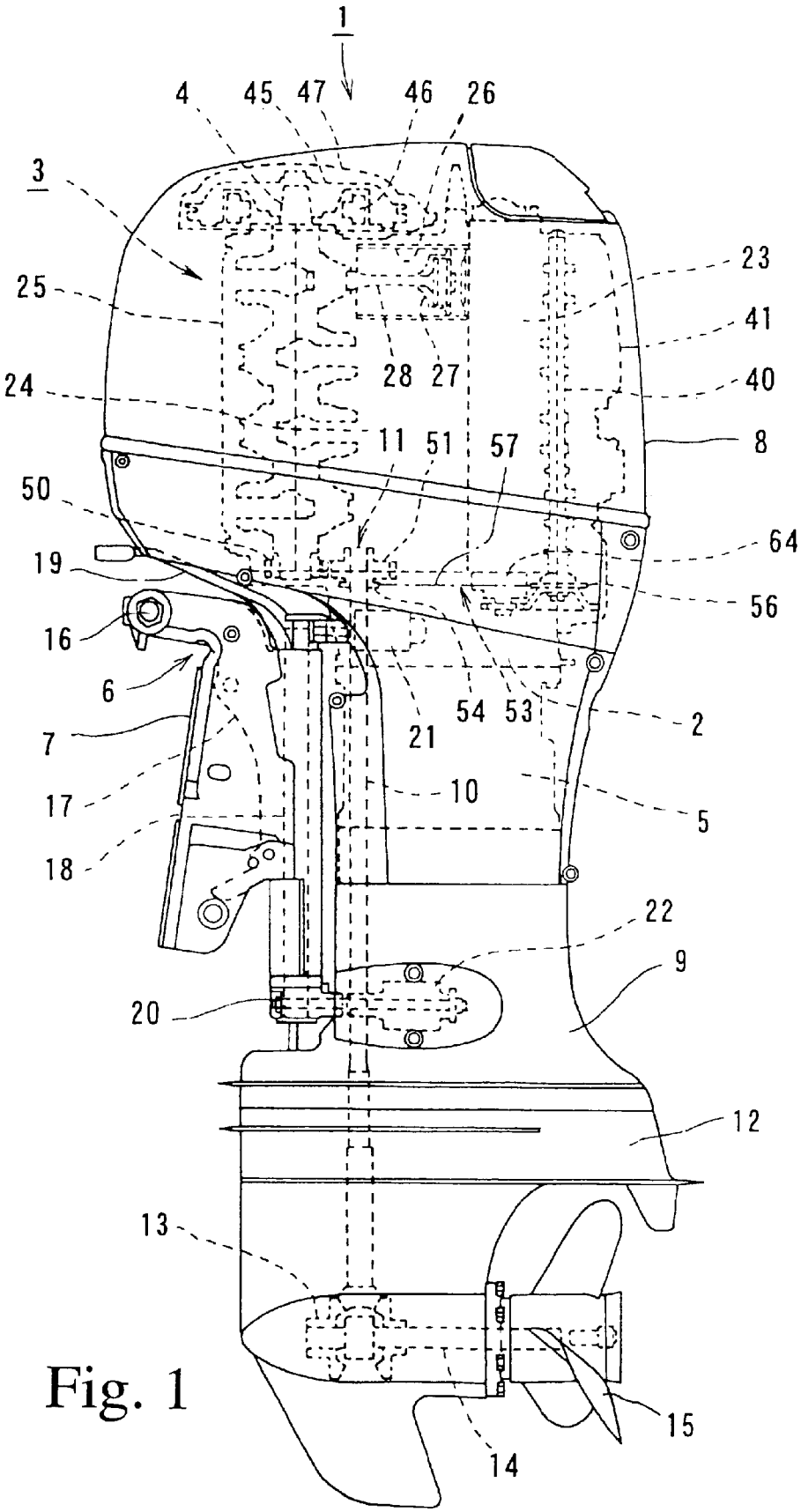
FIG. 1 is a left side view showing an embodiment of an engine holder structure for a four-cycle outboard motor according to the present invention.

FIG. 1 is a left side view showing an embodiment of an outboard motor according to the present invention. As FIG. 1 shows, this outboard motor 1 is equipped with an engine holder 2, and an engine 3 installed above this engine holder 2. This engine 3 is a vertical-type engine having a crankshaft 4 disposed substantially vertically in the interior thereof.

An oil pan 5 is disposed below the engine holder 2. A clamp bracket 7 is, for example, attached via a mounting device 6 to the outboard motor 1. The outboard motor 1 is mounted to a transom in the hull (not illustrated) via this clamp bracket 7. Also, the engine 3, the engine holder 2 and the oil pan 5 of this outboard motor 1 are covered all over by an engine cover 8.

A drive shaft housing 9 is disposed below the oil pan 5. A drive shaft 10 is disposed substantially vertically inside the engine holder 2, the oil pan 5 and a drive shaft housing 9. The upper end of the drive shaft housing 9 is linked to the lower end of the crankshaft 4 via a linking means 11. The drive shaft 10 extends downward through the interior of drive shaft housing 9 and is configured so as to drive a propeller (propulsion device) 15, which is a propelling device, via a bevel gear 13 and a propeller shaft 14 inside a gear case 12 provided below the drive shaft housing 9.

The above-mentioned clamp bracket 7 is provided with a swivel bracket 17 via a tilt shaft 16, and a pilot shaft 18 is pivoted vertically and with rotational freedom inside this swivel bracket 17. An upper mount bracket 19 and a lower mount bracket 20, which also serve as steering brackets, are provided rotationally integrally at the top and bottom ends of this pilot shaft 18.

A pair of left and right upper mounting units 21 are provided at the front part of the engine holder 2, and are connected to the upper mounting bracket 19. Also, a pair of lower mounting units 22 are provided on the opposite sides of the drive shaft housing 9, and are connected to the lower mount bracket 20. A mounting device 6 is then configured in the above way, and the outboard motor 1 becomes capable of steering to the left or the right by turning itself around the pilot shaft 18 with respect to the clamp bracket 7, and becomes capable of tilting up around the tilt shaft 16.

Figure 2:
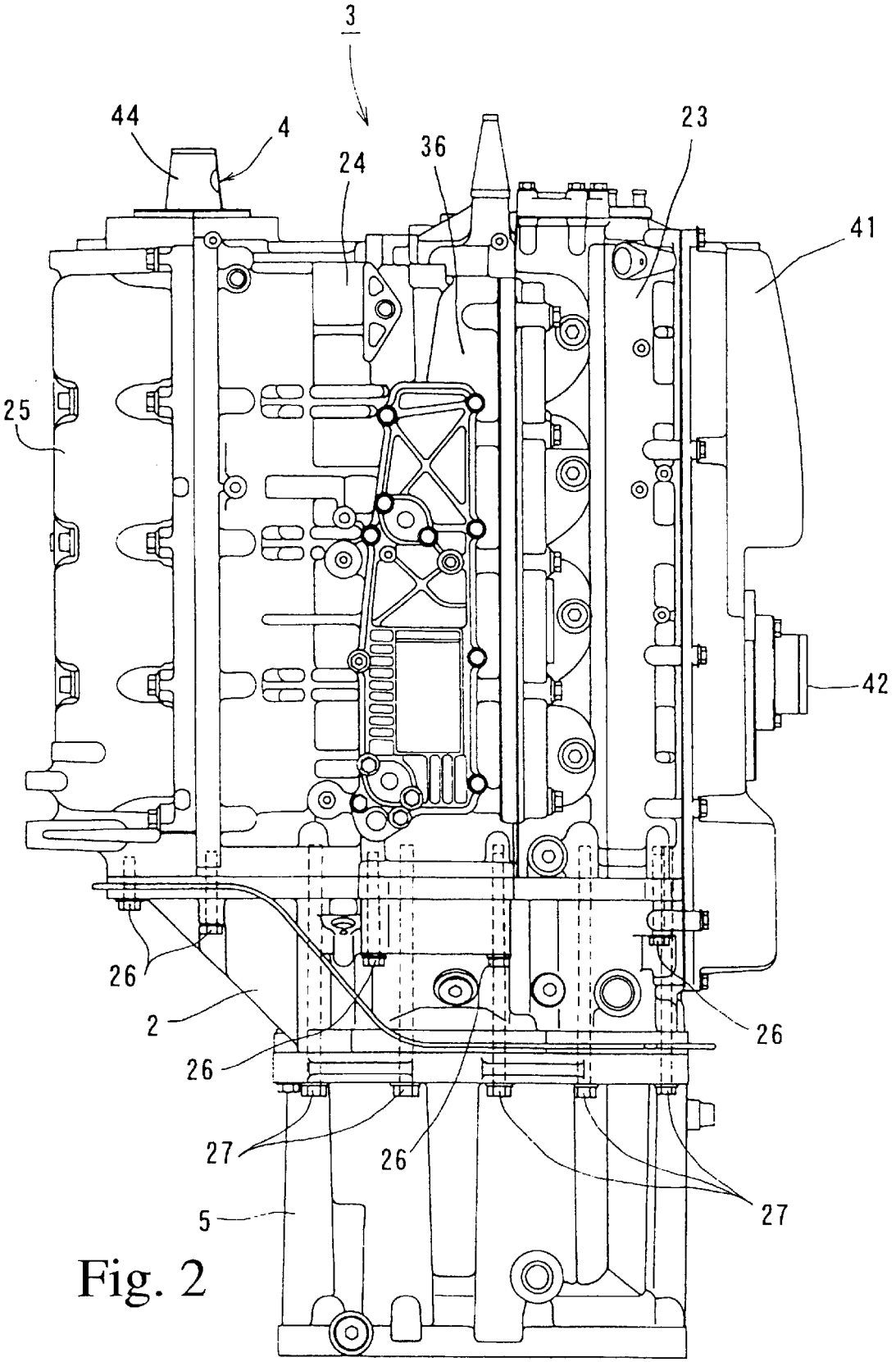
FIG. 2 is an enlarged left side view of the central part of the outboard motor shown in FIG. 1.
Figure 3:
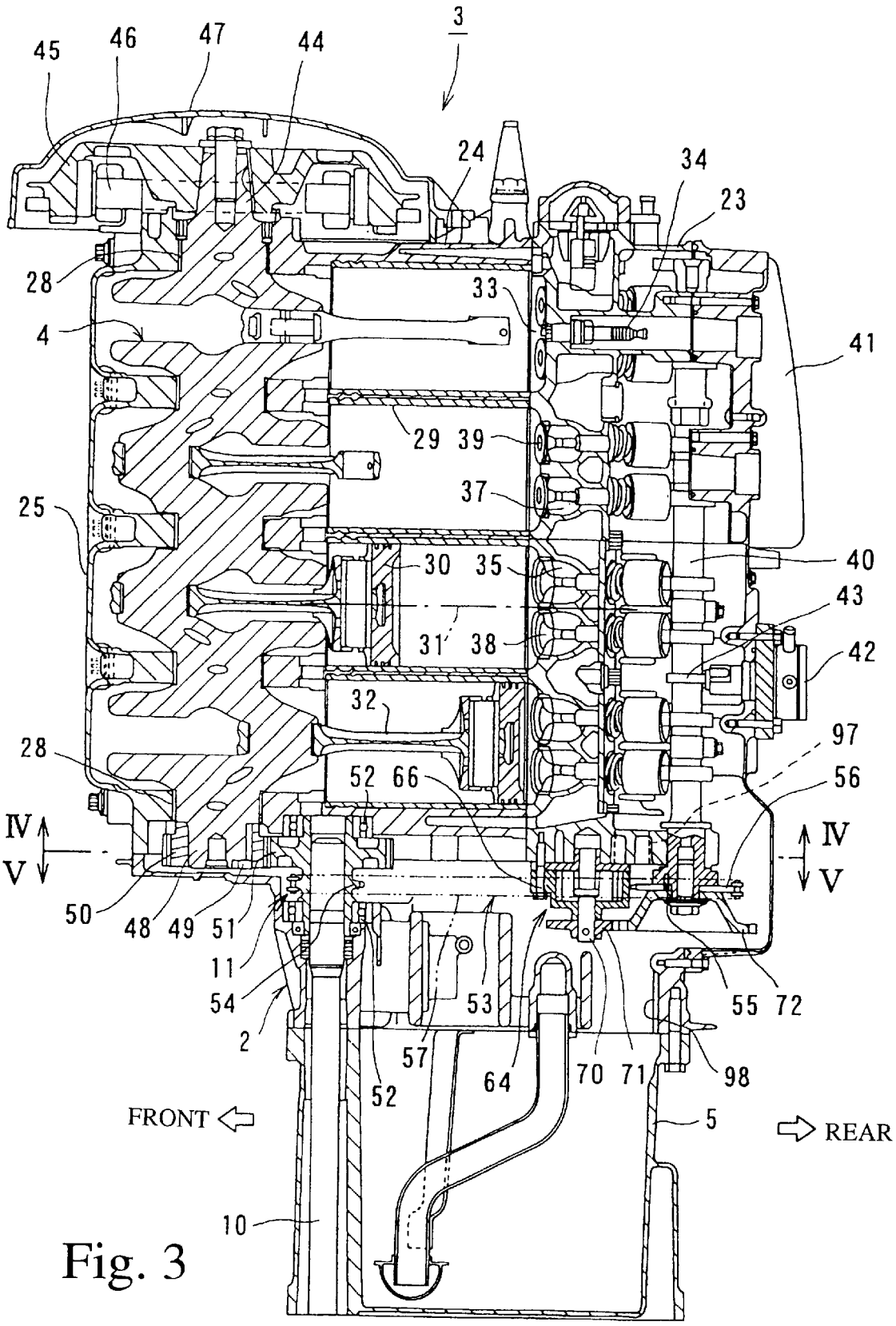
FIG. 3 is a vertical sectional view of the embodiment shown in FIG. 2.
Figure 4:
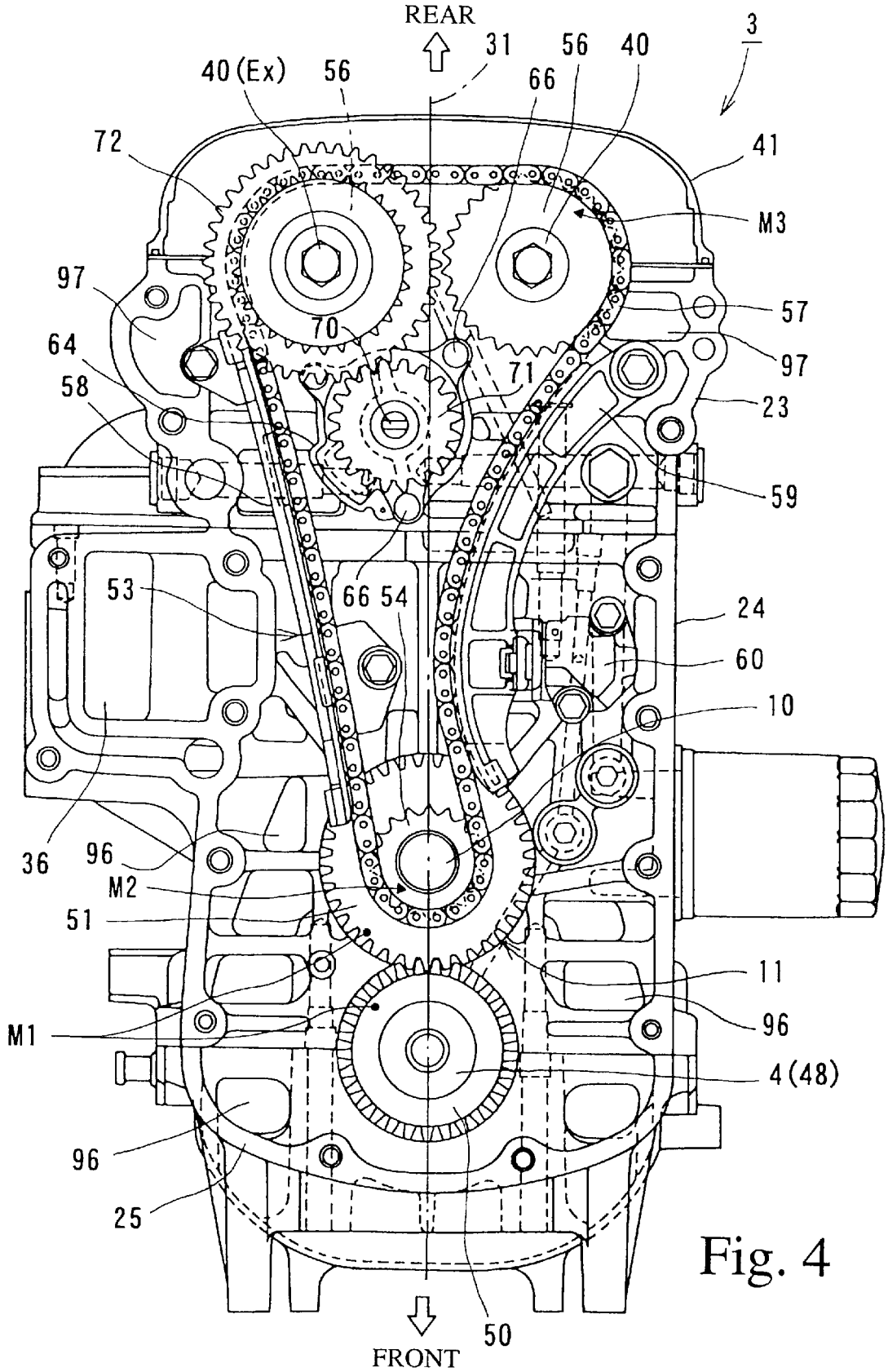
FIG. 4 is a sectional view along line IV—IV in FIG. 3.
Figure 5:
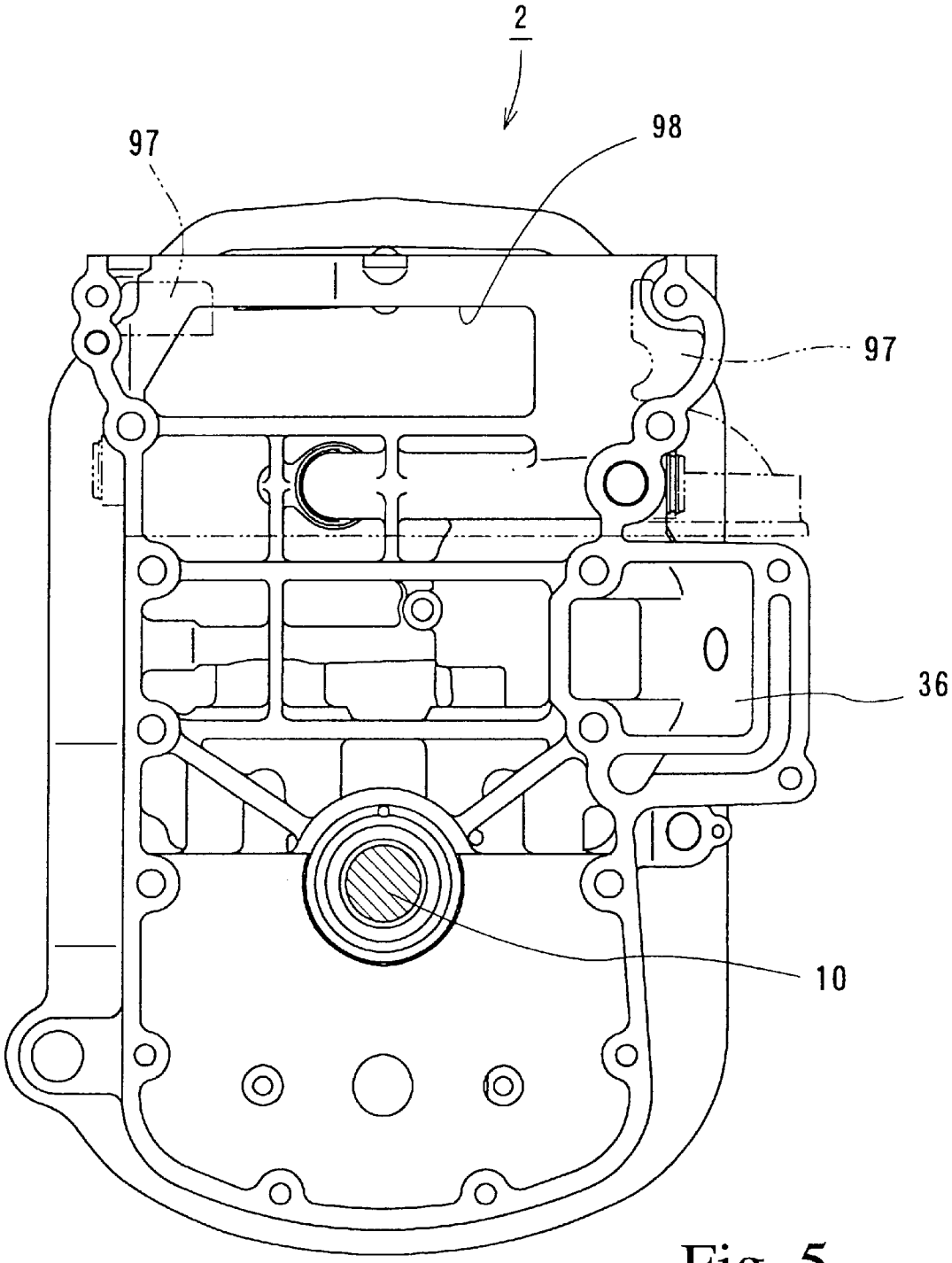
FIG. 5 is a sectional view along line V—V in FIG. 3.

FIG. 2 shows an enlarged left side view of the central part of the outboard motor, and FIG. 3 shows a vertical cross section thereof shown in FIG. 2. Also, FIG. 4 shows a cross section along line IV—IV in FIG. 3, and FIG. 5 shows a cross section along line V—V in FIG. 3. As FIGS. 2 and 3 show, the engine 3 mounted on this outboard motor 1 is a water-cooled four-cycle four-cylinder inline engine configured by assembling, for example, a cylinder head 23, a cylinder block 24, a crankcase 25 and so on.

The cylinder block 24 is disposed behind crankcase 25 (on the right side in FIG. 2 or the boat stern side) which is disposed at the frontmost part of engine 3 at the leftmost side (the bow side) in FIGS. 2 and 3. Also, the cylinder head 23 is disposed behind the cylinder block 24.

As FIG. 2 shows, the lower surfaces of the cylinder head 23, the cylinder block 24 and the crankcase 25 are formed in the same plane and mounted on the upper surface of the engine holder 2. The cylinder head 23, the cylinder block 24 and the crankcase 25 are all securely fixed to the engine holder 2 by a plurality of bolts 26 inserted from the lower surface of the engine holder 2.

Furthermore, a plurality of bolts 27 pass through the engine holder 2 from below the oil pan 5 which is disposed under the engine holder 2, and extend, for example, into the lower parts of the cylinder head 23 and the cylinder block 24, whereby the engine holder 2 and the oil pan 5 are fastened together with and fixed to both cylinder head 23 and cylinder block 24.

Incidentally, although this embodiment describes an example in which the engine holder 2 and the oil pan 5 are fastened together with both cylinder head 23 and cylinder block 24, the components with which the engine holder 2 and the oil pan 5 are fastened together may be any constituent component of the engine 3 or any combination of components. For example, the engine holder 2 and the oil pan 5 may be fastened together with the cylinder block 24 and the crankcase 25 (although not illustrated in detail).

As shown in FIGS. 1 and 3, the crankshaft 4 is pivoted substantially vertically at the interface between the crankcase 25 and the cylinder block 24, as described above, via a plurality of metal bearings 28, for example. Also, four cylinders 29 are formed approximately horizontally in the axes thereof and are aligned in a vertical direction inside the cylinder block 24. A piston 30 is inserted into each cylinders 29 with freedom to slide axially along the axis 31 of each cylinder 29. Furthermore, the crankshaft 4 is linked to each piston 30 by a connecting rod 32, whereby the reciprocating stroke of the each piston 30 is converted into rotational motion of the crankshaft 4.

A combustion chamber 33 is formed in the cylinder head 23 for each cylinder 29 so that all cylinders have corresponding combustion chambers 33, in which spark plugs 34 are plugged from the outside so that the plugs may be connected to the outside. Also, air intake ports 37, which connect with combustion chambers 33, and exhaust ports 35, which connect with exhaust ducts 36 formed on the left side (FIG. 4) of the cylinder block 24 and the engine holder 2, are also formed inside the cylinder head 23. Furthermore, air intake valves 39 and exhaust valves 38 which open and close ports 35 and 37, respectively, are disposed inside the cylinder head 23, and two (air intake and exhaust) valve actuator camshafts 40 which open and close these valves 38 and 39, respectively, are disposed parallel with the crankshaft 4 in the rear part of the cylinder head 23.

The cylinder head 23 is covered by a cylinder head cover 41. A mechanical fuel pump 42 is disposed inside the cylinder head cover 41, and this fuel pump 42 is driven by a cam 43 provided on the camshaft 40.

Also, as shown in FIG. 3, the upper end of the crankshaft 4 projects from the top of the crank case 25 and cylinder block 24. A flywheel 45 and a magneto device 46 for generating electricity are provided on this projecting part 44, and are covered by a magneto cover 47.

As shown in FIGS. 3 and 4, the crankshaft 4 and the drive shaft 10 are disposed with their respective shaft centers offset from each other. As shown in detail in FIG. 4, the central axes of the crankshaft 4 and the drive shaft 10 are, for example, disposed on the axis 31 of the cylinders 29 in plan view, and the shaft center of the drive shaft 10 is disposed offset toward the rear (toward the cylinder head 23) from the shaft center of the crankshaft 4. In the present embodiment, "toward the rear" means "toward the right" in FIGS. 1, 2 and 3. Thus, the central axis of the drive shaft 10 is parallel with that of the crankshaft 4 such that both shaft centers fall on a cylinder axis line 31.

The cylinder axis line 31 may be contained in the longitudinal center plane of the outboard motor. Thus, the cylinder axis line 31 coincides with the longitudinal center line of the outboard motor may in plan view. Here, the plan view may include a cross section projected on the same plane or any cross sectional view may be superimposed on an original plan view to make the plan view. Thus, in the present embodiment, each cylinder axis line 31 may converge single line, and the crankshaft center and the drive shaft center may fall on the single line 31 as shown in FIG. 4. That is, the crankshaft axis and the drive shaft axis are disposed on the axis 31 in plan view.

The above-mentioned mounting device 6 is then disposed in the space directly below the crankshaft 4 that arises due to the drive shaft 10 being offset toward the rear, and the pilot shaft 18 that constitutes this mounting device 6 is disposed approximately on the same axis as the crankshaft 4 (see FIG. 1).

The lower end of the crankshaft 4 projects below the engine 3 and a crank gear 50 whose phase is adjusted by a knock-pin 49 is press-fitted to this projecting part 48, and at the top end of the drive shaft 10, which projects above the engine holder 2, the above-mentioned linking means 11 is, for example, engaged coaxially with the drive shaft 10 by means of a spline, and a driven gear 51 which meshes with the above-mentioned crank gear 50 is integrally formed in this linking means 11. Note that this linking means 11 is supported at the top and the bottom ends thereof by the cylinder block 24 and the engine holder 2 via ball bearings 52, for example.

Then, as the crankshaft 4 rotates, the rotational force thereof is transmitted from the crank gear 50 to the driven gear 51, whereby the rotational drive is applied to the drive shaft 10. Note that although the crank gear 50 and the driven gear 51 are not illustrated in detail, they are for example "helical gears" whose twisting direction is such that, when the engine 3 is turning in the normal direction, the crankshaft 4 and the drive shaft 10 generate thrust forces in upward and downward directions, respectively. Also, the driven gear 51 is provided with a greater number of teeth than the crank gear 50, whereby the drive shaft 10 is rotationally driven at a lower speed than the crankshaft 4. Note that phase alignment marks M1 for the crank gear 50 and the driven gear 51 are respectively provided on the lower surfaces (toward the engine holder 2) of these gears 50 and 51.

In the space between the lower part of the engine 3 and the upper surface of the engine holder 2, a camshaft drive mechanism 53 is provided which transmits the rotation of the crankshaft 4 to the camshaft 40, thereby rotationally driving the camshaft 40. This camshaft drive mechanism 53 (e.g., a chain drive mechanism) comprises a timing sprocket 54 which is formed integrally with the above-mentioned linking means 11 below the driven gear 51 formed into the linking means 11, a pair of left and right (intake and exhaust) cam sprockets 56 which are provided at the bottom end of the two camshafts 40 projecting from the lower surface of the engine 3 and whose phase is aligned by a knock-pin 55 so that they rotate integrally, and a timing chain 57 which is wrapped around the outside of these sprockets 54 and 56. The ratio of the number of teeth in the timing sprocket 54 to the number of teeth in the cam sprocket 56 is set to less than 1:2. The number of teeth on each gear and sprocket is set so that the final ratio of rotational speeds of the crankshaft 4 and the camshaft 40 becomes 2:1.

A chain guide 58 and a chain tensioner 59 provided at the lower surface of the engine 3 ensure that the free play and tension in timing chain 57 are always suitable. The Chain guide 58 is disposed on the tensioned side (exhaust side) of the timing chain 57 and is fixed astride the lower surfaces of the cylinder head 23 and the cylinder block 24. The chain tensioner 59 is disposed on the relaxed side (air intake side) of the timing chain 57, one end of which is pivoted with rotational freedom at the lower surface of cylinder head 23 so that the tension is adjusted by a tension adjuster 60 provided at the lower surface of the cylinder block 24, whereby the chain tensioner 59 is pushed toward the timing chain 57. An alignment mark M2 for the timing chain 57 is provided at the lower surface (toward engine holder 2) of the timing sprocket 54. Also, an alignment mark M3 for the timing chain 57 is similarly provided at the lower surface (toward the engine holder 2) of the cam sprocket 56.

Incidentally, the camshaft drive mechanism 53 in the above-mentioned embodiment is configured so that the linking means 11 and the camshaft 40 are respectively provided with the timing sprocket 54 and the cam sprocket 56, and that the timing chain 57 is wrapped around these sprockets 54 and 56. According to the present invention, pulleys (not illustrated) instead the sprockets 54 and 56 may be used. And a timing belt (not illustrated) instead the timing chain 57 may be used.

An oil pump 64 is disposed in the space enclosed by the timing chain 57 below the engine 3. The oil pump 64 is, for example, an ordinary trochoid pump. By way of example, it is fixed with bolts 66 or the like to the lower surface of the cylinder head 23, with a pump drive shaft 70 projecting below the oil pump 64. A pump driven gear 71 is then provided at the projecting end of this pump drive shaft 70. A pump drive gear 72 is provided at the bottom end of one of the two camshafts, the exhaust camshaft 40 (Ex) in the present embodiment, so as to rotate integrally with the above-mentioned exhaust cam sprocket 56. This pump drive gear 72 is operationally linked to the pump driven gear 71.

The pump drive gear 72 is provided with a greater number of teeth than the pump driven gear 71 so as to drive the pump drive shaft 70 at a greater rotational speed than the camshaft 40. The oil pump 64 draws lubricating oil from inside the oil pan 5 and feeds it under pressure to each part of the engine 3.

The lubricating oil that is guided into the crankcase 25 and the cylinder block 24 and lubricates each part thereof naturally falls into the oil pan 5 via the engine holder 2 from oil drop holes 96 in a plurality of locations formed in the lower surfaces of the crankcase 25 and the cylinder block 24, and is thereby recovered. These oil drop holes 96 are suitably disposed at positions avoiding moving parts such as the timing chain 57, the driven gear 51 and the crank gear 50 so that the oil temperature does not increase due to the lubricating oil falling through the holes coming into contact with these parts.

Also, the lubricating oil that is guided into the cylinder head 23 and lubricates each part naturally falls from oil drop holes 97 in a plurality of locations formed at the mating surface side between the cylinder head 23 and the engine holder 2 at the lower surface of the cylinder head 23 into the oil pan 5 via oil drop holes 98 formed at the mating surface side between the cylinder head 23 and the engine holder 2 at the upper surface of the engine holder 2, and is thereby recovered. The oil drop holes 97 formed in the lower surface of the cylinder head 23 are also suitably disposed at positions avoiding moving parts such as the timing chain 57, the cam sprocket 56, the pump drive gear 72 and the pump driven gear 71 so that the oil temperature does not increase due to the lubricating oil falling through the holes coming into contact with these parts.

The action of the present embodiment is described next.

When the engine 3 starts up, the crankshaft 4 rotates and the drive shaft 10 is driven via the linking means 11. The rotation of the linking means 11 also drives the camshaft 40 via the timing chain 57, whereby the air intake valves 39 and the exhaust valves 38 are opened and closed and the fuel pump 42 is also driven.

The oil pump 64 is driven by the rotation of the camshaft 40, whereby the lubricating oil inside the oil pan 5 is sent under pressure to the engine 3.

Since the cylinder head 23, the cylinder block 24 and the crankcase 25 are all securely fixed to the engine holder 2 by the bolts 26, the area of the connecting interface between the engine 3 and the engine holder 2 is larger and the attachment rigidity of the engine 3 is greatly increased. Here, the area of the connecting interface means any areas where the engine holder 2 and any of the engine components are connected directly or indirectly, for example, via a gasket, a shim and so on. Thus, the engine holder 2 and any of the engine components may share the connecting area at the interface. The means for connecting the engine holder 2 and any of the engine components may be anything known to the public such as a bolt, a clamp, a rivet, etc.

Thus, the cylinder head 23, the cylinder block 24 and the crankcase 25 are not only securely fixed in this order with an appropriate fastener such as a bolt to make the entire engine but also securely fixed on the upper face of one piece of the engine holder 2 so that the engine assembly may be supported by the engine holder 2 attached to the bottom face of the engine. In order to make such structure, the engine holder 2 has a larger area on the interface with the engine than any area of each counter part of the cylinder head 23, the cylinder block 24 or the crankcase 25. In particular, the longitudinal length of the engine holder 2 is important and is longer than that of the cylinder block 24 such that the interface of the engine holder 2 covers at least partially the interfaces of the cylinder head 23 and the crankcase 25. Although the length of the engine holder 2 may exceed the length of the engine 3 without losing assembly rigidity of the engine 3, it is preferable that the engine holder has the same or shorter length to make a compact outboard motor.

The engine holder 2 may be shaped like a box, a thick plate, a trapezoid, etc. in the cross section although it may have a vacancy inside. The engine holder 2 may be formed in a variety of shape to make a good performance for rigidity, vibration and noise reduction, and so on. The oil pan 5 is usually shorter and narrower than the engine 5 so that small amount of lubricating oil is required. Therefore, the engine holder 2, which has a larger interface at the top face and a smaller interface at the bottom face, may serve as a transition structure from the engine 3 to the oil pan 5.

The engine holder 2 has a chamfered (or slant) shape in a front portion in the side view as shown in FIG. 2. The slant portion is formed only in right and left portions of the engine holder 2 and the cross section in FIG. 3 does not show the slant portion in the front portion of the engine holder 2. The engine holder 2 with such structure allows some available room just beneath the crankshaft 4 so that a mounting system including the substantially vertical pilot shaft 18, the swivel bracket 17, etc. is at least partially disposed in such room to make a compact outboard motor. The shape of the front portion of the engine holder 2 may vary to fit a desirable equipment.

Since the pair of upper mounting units 21 are provided at the front part of the engine holder 2, the engine 3 is securely fastened to the mounting system via the engine holder 2.

Also, since the cylinder head 23 is securely fixed to the engine holder 2, it is possible to form the oil drop holes 97 at the side of the interface between the cylinder head 23 and the engine holder 2 at the lower surface of the cylinder head 23 and to form the oil drop holes 98 at the side of the interface between the cylinder head 23 and the engine holder 2 at the upper surface of the engine holder 2. As a result, the lubricating oil that is fed into the cylinder head 23 and lubricates each part thereof can be directly returned to the oil pan 5, thus eliminating the need for a return oil duct from the cylinder head 23 that has hitherto been formed inside the cylinder block 24, and thereby allowing the structure of the cylinder block 24 to be simplified, making it easier to produce and reducing its weight.

Also, by using the bolts 27 to secure the engine holder 2 and the oil pan 5 together with, for example, both cylinder head 23 and cylinder block 24 which constitute the engine 3, it is possible to form the cylinder head 23, the cylinder block 24, the engine holder 2 and the oil pan 5 into an integral unit, making the engine 2 a rigid member of the whole of outboard motor 1 instead of simply being coupled thereto. Since the engine 3 and the oil pan 5 are securely fixed astride the engine holder 2 by the same bolts 27, it is possible to cut down on the overall number of the fixing bolts 26 and 27 without impairing the assembled rigidity of the outboard motor 1, and it is possible to cut down the number of components and the amount of labor required for assembly.

Note that although the present invention is applied to the four-cylinder inline engine 3 in the above-mentioned embodiment, the present invention can be applied irrespective of the number of cylinders. Furthermore, the present invention can also be applied to so-called V-shape engines where a plurality of cylinders are disposed in a V shape as seen in plan view.

Also, although in the above-mentioned embodiment, the present invention is applied to the outboard motor 1 in which the shaft center of the drive shaft 10 is offset to the rear of the shaft center of the crankshaft 4 (toward the cylinder head 23), the present invention can also be applied to outboard motors in which the shaft center of a drive shaft 10 is offset in some other direction, or to conventional outboard motors in which a crankshaft 4 and a drive shaft 10 are joined together coaxially.

Advantages of the Invention

As described above, in an engine holder structure for a four-cycle outboard motor wherein an engine whose principal components are a crankcase, a cylinder block and a cylinder head is mounted on an engine holder, wherein the oil pan is disposed therebelow, wherein the crankshaft is disposed substantially vertically inside the engine, and wherein the rotational force of this crankshaft is transmitted to a propulsion device via a drive shaft, since the shaft center of the drive shaft is disposed offset from the shaft center of the crankshaft, the freedom of layout is increased and the engine can be more compact.

Also, in an engine holder structure for a four-cycle outboard motor wherein an engine whose principal components are a crankcase, a cylinder block and a cylinder head is mounted on an engine holder, wherein the oil pan is disposed therebelow, wherein a crankshaft is disposed substantially vertically inside the engine, and wherein the rotation of this crankshaft is transmitted to a propulsion device via a drive shaft, since the shaft center of the drive shaft is disposed offset from the shaft center of the crankshaft, and since the cylinder head, the cylinder block and the crankcase are all securely fixed to the engine holder, the attachment rigidity of the engine is improved.

Furthermore, since the engine holder and the oil pan are further fastened together with at least one of the components, for example, the cylinder block and the cylinder head of the engine, the attachment rigidity of the engine is improved and it is possible to cut down on the number of the components and the amount of labor required for assembly.

Also, since an oil drop hole is formed in the lower surface of the cylinder head at the side of the interface between the cylinder head and the engine holder, and another oil drop hole is formed in the upper surface of the engine holder at the side of the interface between the cylinder head and the engine holder, the structure of the cylinder block is simplified and its weight is also reduced.

Also, since the shaft center of said drive shaft is disposed offset to the rear of the shaft center of said crankshaft, the engine can be more compact.

What is claimed is:

1. An engine holder structure in a four-cycle outboard motor having an engine principally comprised of a crankcase, a cylinder block and a cylinder head, the engine having a crankshaft inside disposed substantially vertically such that rotational force of the crankshaft is transmitted via a drive shaft to a propulsion device, an engine holder on which the engine is mounted, and an oil pan being disposed below the engine holder;

wherein the shaft center of the drive shaft is disposed offset from the shaft center of the crankshaft;

wherein the cylinder head, the cylinder block and the crankcase are securely fixed to the engine holder; and wherein the oil pain is securely fixed to the engine holder together with the cylinder block and the cylinder head.

2. An engine holder structure in a four-cycle outboard motor according to claim 1 further comprising:

an oil drop hole formed in the engine holder such that lubricating oil falls from another oil drop hole in the cylinder head.

3. An engine holder structure in a four-cycle outboard motor having an engine principally comprised of a crankcase, a cylinder block and a cylinder head, the engine having a crankshaft inside disposed substantially vertically such that rotational force of the crankshaft is transmitted via a drive shaft to a propulsion device, an engine holder on which the engine is mounted, and an oil pan being disposed below the engine holder;

wherein the shaft center of the drive shaft is disposed offset from the shaft center of the crankshaft;

wherein the cylinder head, the cylinder block and the crankcase are securely fixed to the engine holder; and an oil drop hole formed in the engine holder such that lubricating oil falls from another engine drop hole in the cylinder head.

4. An engine holder structure in a four-cycle outboard motor having an engine principally comprised of a crankcase, a cylinder block and a cylinder head, the engine having a crankshaft inside disposed substantially vertically such that rotational force of the crankshaft is transmitted via a drive shaft to a propulsion device, an engine holder on which the engine is mounted, and an oil pan being disposed below the engine holder;

wherein the shaft center of the drive shaft is disposed offset from the shaft center of the crankshaft;

wherein the cylinder head, the cylinder block and the crankcase are securely fixed to the engine holder;

wherein the oil pan is securely fixed to the engine holder together with at least one of the components of the engine; and an oil drop hole formed in the engine holder such that lubricating oil falls from another oil drop hole in the cylinder head.

5. An engine holder structure in a four-cycle outboard motor having an engine principally comprised of a crankcase, a cylinder block and a cylinder head, the engine having a crankshaft inside disposed substantially vertically such that rotational force of the crankshaft is transmitted via a drive shaft to a propulsion device, an engine holder on which the engine is mounted, and an oil pan being disposed the engine holder;

wherein the shaft center of the drive shaft is disposed offset from the shaft center of the crankshaft;

wherein the cylinder head, the cylinder block and the crankcase shares connection areas with the engine holder on a top side of the engine holder; and wherein the oil pan is securely fixed to the engine holder together with the cylinder block and the cylinder head.

6. An engine holder structure in a four-cycle outboard motor having an engine principally comprised of a crankcase, a cylinder block and a cylinder head, the engine having a crankshaft inside disposed substantially vertically such that rotational force of the crankshaft is transmitted via a drive shaft to a propulsion device, an engine holder on which the engine is mounted, and an oil pan being disposed the engine holder;

wherein the shaft center of the drive shaft is disposed offset from the shaft center of the crankshaft;

wherein the cylinder head, the cylinder block and the crankcase shares connection with the engine holder on a top side of the engine holder; and an oil drop hole formed in the engine holder such that lubricating oil falls from another oil drop hole in the cylinder head.

7. An engine holder structure in a four-cycle outboard motor having an engine principally comprised of a crankcase, a cylinder block and a cylinder head, the engine having a crankshaft inside disposed substantially vertically such that rotational force of the crankshaft is transmitted via a drive shaft to a propulsion device, an engine holder on which the engine is mounted, and an oil pan being disposed below the engine holder;

wherein the shaft center of the drive shaft is disposed offset from the shaft center of the crankshaft;

wherein the cylinder head, the cylinder block and the crankcase are securely fixed to the engine holder;

wherein the oil pain is securely fixed to the engine holder together with the cylinder block and the cylinder head; and an oil drop hole formed in the engine holder such that lubricating oil falls from another oil drop hole in the cylinder head.

* * * * *